US005717660A

United States Patent [19]

Kohata

[11] Patent Number: 5,717,660

[45] Date of Patent: Feb. 10, 1998

[54] ROTARY DECORATION DRIVING DEVICE

[75] Inventor: Shigeru Kohata, Tokyo, Japan

[73] Assignee: Seiko Clock Inc., Japan

[21] Appl. No.: 523,867

[22] Filed: Sep. 6, 1995

[30] Foreign Application Priority Data

Sep. 7, 1994 [JP] Japan ..... 6-213880

[51] Int. Cl.[6] ..... G04B 17/02

[52] U.S. Cl. ..... 368/180; 368/134

[58] Field of Search ..... 368/179, 180

[56] References Cited

U.S. PATENT DOCUMENTS

| | | | |
|---|---|---|---|
| 937,792 | 10/1909 | Grivolas | 368/180 |
| 3,491,258 | 1/1970 | Siefert | 368/10 |
| 3,986,336 | 10/1976 | Heim | 368/180 |
| 4,707,143 | 11/1987 | Hanya | 368/165 |
| 5,425,005 | 6/1995 | Urabe et al. | 368/134 |

FOREIGN PATENT DOCUMENTS

| | | |
|---|---|---|
| 59-27536 | 8/1984 | Japan . |
| 3-39748 | 8/1991 | Japan . |

*Primary Examiner*—Bernard Roskoski
*Attorney, Agent, or Firm*—Adams & Wilks

[57] ABSTRACT

A rotary decoration driving device comprises a case, a first rotary shaft having a first end portion rotatably supported by the case and a second end portion supporting a first decoration for rotation therewith. A second rotary shaft is mounted on the first rotary shaft for rotation therewith and has an end portion supporting a second decoration for rotation therewith. A first gear is mounted on the first rotating shaft for rotation therewith, and a second gear is mounted on the second rotating shaft for rotation therewith. At least one intermediate gear is driven to undergo intermittent rotation. A transmitting device transmits the intermittent rotation of the intermediate gear to the first and second gears. A smoothing device smoothens the intermittent rotation of the intermediate gear to thereby transmit a smooth and continuous rotary motion to the first and second gears.

29 Claims, 3 Drawing Sheets

ROTARY DECORATION DRIVING DEVICE

BACKGROUND OF THE INVENTION

1. Field of the Invention

This invention relates to a device which is employed in a table clock, or the like for driving its rotary decorations.

2. Description of the Prior Art

The known rotary decorations for a clock are heavy in weight, since they are made of glass, or like material that is used to increase their ornamental value. Therefore, a heavy thrust load bears on the bearings at the bottom of a rotary shaft and produces a large amount of friction and wear thereon.

Under these circumstances, there is known a bearing device which supports a rotary shaft in a floating fashion by repulsion between a first permanent magnet mounted on a receiving plate and a second permanent magnet secured to the rotary shaft, as disclosed in Japanese Utility Model Publication No. Sho 59-27536. An adhesive is, however, employed for securing the first permanent magnet to the receiving plate. The adhesive bonding of the magnet to the plate calls for a great deal of time and care, including a considerably long time for which it is necessary to wait before the adhesive solidifies. The device is, therefore, unsuitable for manufacture on a mass-production basis. Moreover, it is likely that the adhesive may peel off, resulting in the separation of the magnet from the plate, if the device is subjected to a strong impact during transportation, or at any other time.

Another known device intended for reducing any thrust load on the bearings employs two pairs of permanent magnets for supporting two rotary shafts, respectively, in a floating fashion, as disclosed in Japanese Utility Model Publication No. Hei 3-39748, column 5, lines 23 to 38. Each pair of magnets consists of a magnet secured to each rotary shaft, from which a torsion pendulum is suspended, and a magnet fixed to a case. The installation of the four magnets requires a large space, gives an undesirably large thickness to the device, and also adds to the cost of its manufacture.

We have proposed a magnetically floating rotary decoration driving device having three permanent magnets, instead of four, in our Japanese Patent Application No Hei 5-261029. We have, however, found that the device has the disadvantage of not ensuring the uniform rotation of two rotary decorations.

SUMMARY OF THE INVENTION

It is, therefore, an object of this invention to provide a rotary decoration driving device which ensures the uniform rotation of two rotary decorations.

This object is attained by a rotary decoration driving device which comprises a first rotary shaft supported rotatably on a lower case, extending vertically through an intermediate plate and carrying a first rotary decoration, and a second rotary shaft fitted about the first rotary shaft rotatably and movably in the direction of gravity, and carrying a second rotary decoration, the first rotary shaft being provided with a first gear, while the second rotary shaft is provided with a second gear connected to the first gear by a train of wheels, one of the first gear and the lower case having a first protrusion, while the other has a first recess in which the first protrusion is loosely fitted, one of the second gear and the intermediate plate having a second protrusion, while the other has a second recess in which the second protrusion is loosely fitted, a first gap disposed between the first protrusion and the first recess and a second gap disposed between the second protrusion and the second recess, the first and second gaps being filled with a viscous liquid.

When the first and second rotary decorations are being driven, a first viscosity resistance occurring to the preferably first gear is substantially equal to a second viscosity resistance occurring to the second gear.

Other features and advantages of the invention will become apparent from the following description and the accompanying drawings.

DETAILED DESCRIPTION OF THE INVENTION

Figure 1:
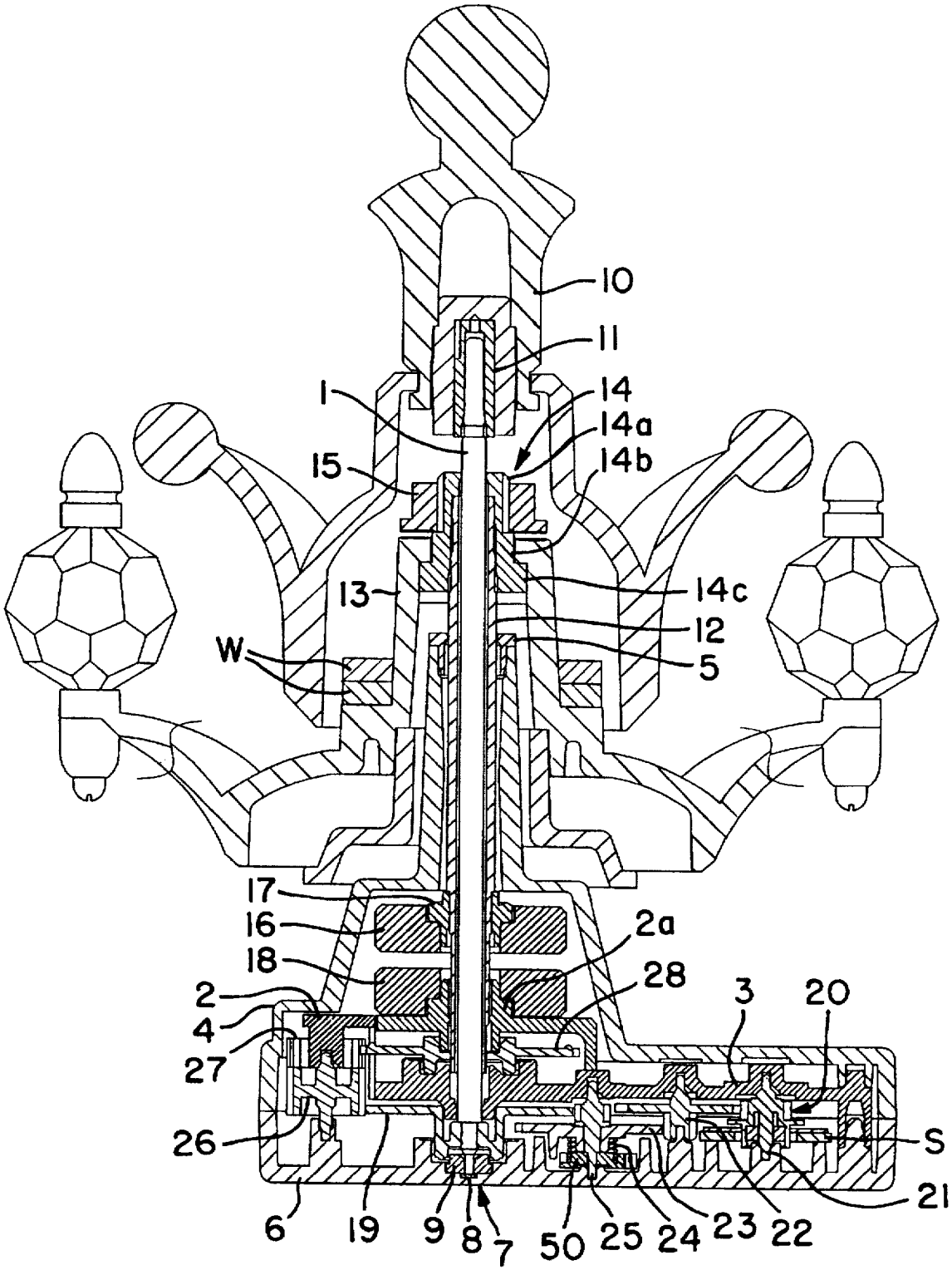
FIG. 1 is an elevational view, partly in section, of a device embodying this invention.
Figure 2:
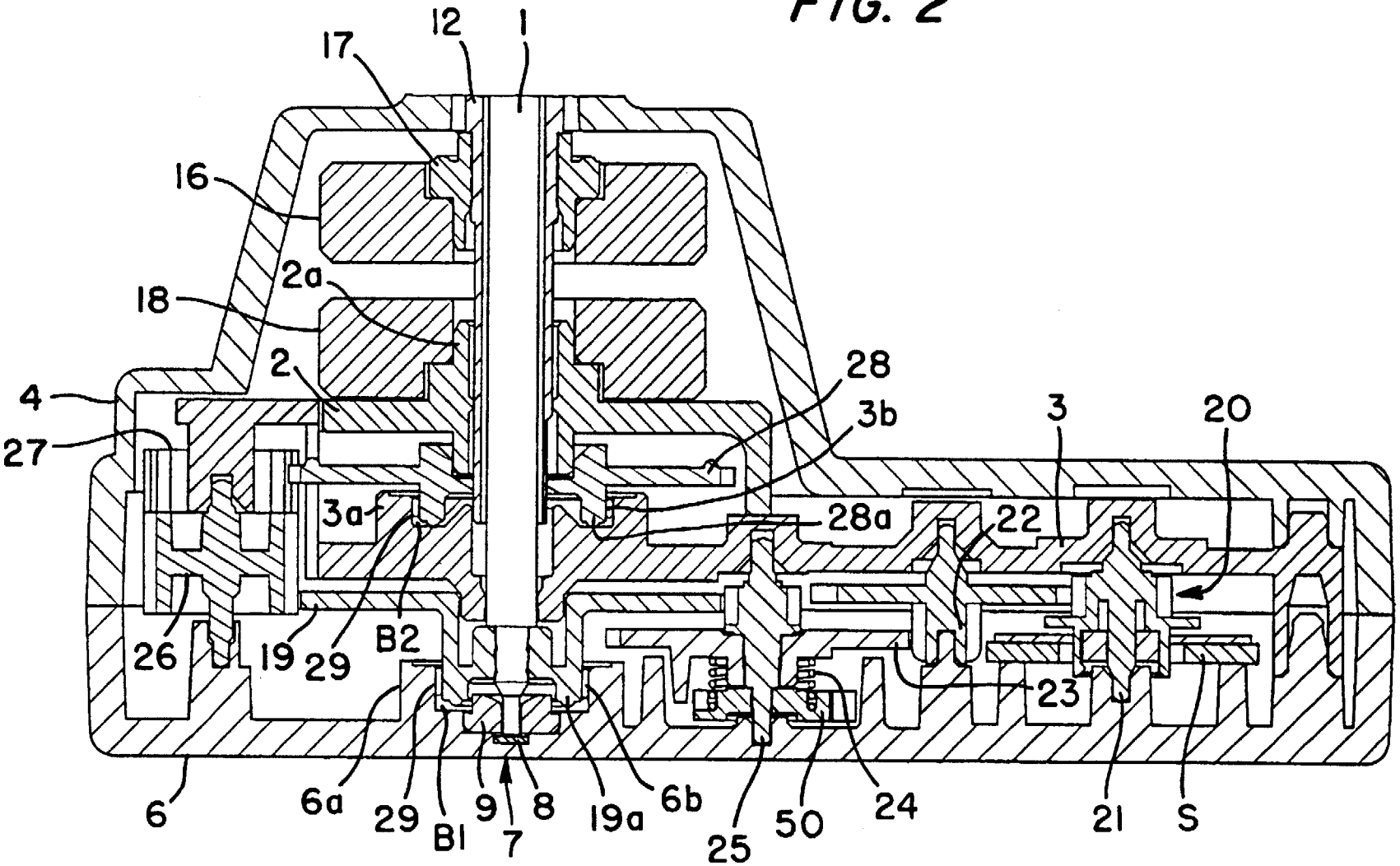
FIG. 2 is an enlarged view of a part of the device shown in FIG. 1.

A device embodying this invention is shown in the drawings and includes a first rotary shaft 1 extending vertically through a cover 2 and an intermediate plate 3 and supported rotatably by a bearing 5 fitted tightly in the upper end of an upper case 4 and a bearing 7 provided in a lower case 6, as shown in FIGS. 1 and 2. The bearing 7 comprises a receiving stone 8 formed from ruby and serving to bear a thrust load, and a bushing 9 formed from a plastic material and serving to bear a radial load. The first rotary shaft 1 has an upper end portion projecting above the upper case 4 and carrying a first rotary decoration 10 on a first sleeve 11 fitted tightly about the shaft 1.

The device also includes a second rotary shaft 12 which is hollow, and fitted about the first rotary shaft 1 rotatably and movably in the direction of gravity. The second rotary shaft 12 has an upper end portion projecting above the upper case 4 and carrying a second rotary decoration 13 on a second sleeve 14 fitted tightly about the shaft 12 and spaced below the first sleeve 11. The second rotary decoration 13 carries an adjusting weight W secured thereto.

The second sleeve 14 has a threaded screw portion **14*a* having a screw thread on its outer peripheral surface, an engaging shaft portion 14*b* formed under the screw portion 14*a* and having an outside diameter which is larger than that of the screw portion 14*a*, and a support portion 14*c* formed under the engaging shaft portion 14*b* and having an outside diameter which is larger than that of the engaging shaft portion 14*b*. The screw portion 14*a* surrounds the outer or upper end of the second rotary shaft 12. The second rotary decoration 13 engages the engaging shaft portion 14*b* and is rotatably supported on the support portion 14*c*, while the screw portion 14*a* projects from the second rotary decoration 13. A nut 15 is threadedly fitted about the screw portion 14*a* for holding the second rotary decoration 13 against detachment from the sleeve 14**.

Although the second sleeve 14 has been described as having three portions, it may alternatively consist of only the screw and support portions **14*a* and 14*c* without having the engaging shaft portion 14*b*. Moreover, the nut 15 is not necessary if a clock case, or the like can be employed for holding the second rotary decoration 13** against detachment.

A bush 17 is secured to the second rotary shaft 12 below its middle portion, and a first permanent magnet 16 is tightly fitted about the bush 17.

The cover 2 is situated above the intermediate plate 3. The cover 2 has an upper surface on which a second permanent magnet 18 is secured. The cover 2 has a bush-shaped projection 2a forming an integral part of its upper surface and the second permanent magnet 18 is tightly fitted about the projection 2a. The second rotary shaft 12 engages the projection 2a and extends through it. The second permanent magnet 18 is situated below the first permanent magnet 16, faces it and repels it magnetically, since the magnets 16 and 18 are so magnetized that the mutually facing surfaces may be of the same magnetic pole. Thus, the magnetic repulsion of the magnets 16 and 18 restricts the downward movement of the second rotary shaft 12.

The bush 17 has an upper surface projecting above the upper surface of the first permanent magnet 16, so that the upper surface of the bush 17 may abut on the upper case 4 to restrict the upward movement of the second rotary shaft 12.

Description will now be made of a mechanism provided between the intermediate plate 3 and the lower case 6 for rotating the first and second rotary shafts 1 and 12. A fourth wheel 19 as a first gear is secured to that portion of the first rotary shaft 1 which projects below the intermediate plate 3. The rotation of a stepping motor 20 as a source of driving force is transmitted to the fourth wheel 19 through a rotor pinion 21, a second wheel 22, a third wheel 23 and a disk member 50 provided with a coil spring 24 for smoothing the rotation, and a transmitting shaft 25. The rotation is further transmitted from the fourth wheel 19 to a seventh wheel 28 as a second gear through a fifth wheel 26 and a sixth wheel 27 as a train of wheels to rotate the second a rotary shaft 12 with the first rotary shaft 1. The second rotary shaft 12 and the seventh wheel 28 are not rotatable independently of each other, but are axially slidable along each other.

Figure 3:
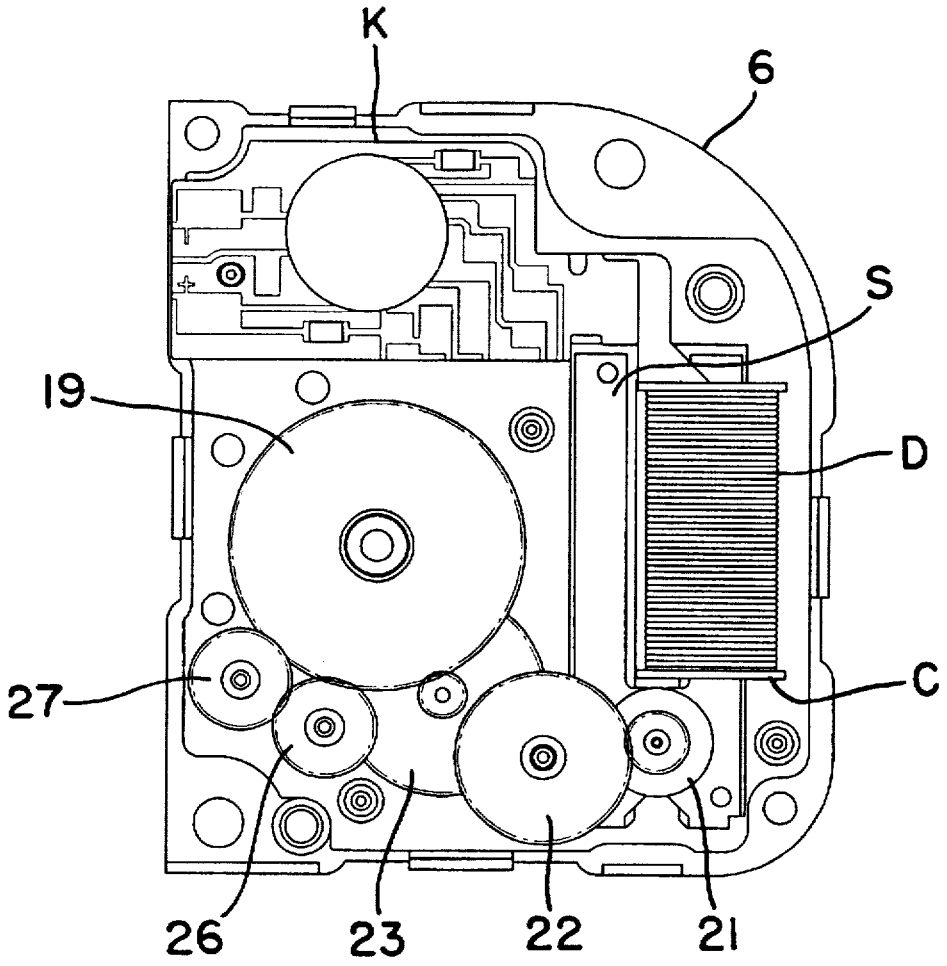
FIG. 3 is a top plan view of a part of the device shown in FIG. 1.

The stepping motor 20 comprises the rotor pinion 21, a stator S, a driving coil D and a coil bobbin C, as show in FIG. 3. The rotor pinion 21 is driven by a driving circuit formed on a printed-circuit board K, though not shown. The sixth wheel 27 is an idler for enabling the first and second rotary shafts 1 and 12 to rotate in the opposite directions.

The first tubular shaft portion or gear 19 has a first protrusion 19a, as shown in FIG. 2. The lower case cavity 6 has an annular wall projection 6a defining a first cavity or 6b in which the first protrusion 19a is loosely fitted. The first protrusion 19a and the first clearance or recess 6b define therebetween a first gap B1 which is filled with portion or a viscous liquid 29 such as grease.

The second tubular shaft gear 28 has a second protrusion 28a. The intermediate plate 3 has an annular projection 3a defining a second cavity or recess 3b in which the second protrusion 28a is loosely fitted. The second protrusion 28a and the second recess 3b define therebetween a second clearance gap B2 which is also filled with a viscous liquid 2a, such as grease.

The annular wall projection 6a, the first recess 6b, the first protrusion 19a, the first gap B1, the annular projection 3a, the second protrusion 28a, the second recess 3b, the second gap B2 and the viscous liquid 29 disposed in the first and second gaps B1,B2 constitute smoothing means for smoothing the intermittent rotation of the stepping motor 20 to thereby transmit a smooth and continuous rotaty motion to the fourth wheel 19 and the seventh wheel 28.

A first viscosity resistance R1 occurring to the fourth wheel 19 and depending on the weight of the first rotary decoration 10, the weight of the first rotary shaft 1, the diameter of the first protrusion 19a, the diameter of the first recess 6b, the size of the first gap B1 and the viscous liquid 29 is substantially equal to a second viscosity resistance R2 occurring to the seventh wheel 28 and depending on the weight of the second rotary decoration 13, the weight of the second rotary shaft 12, the diameter of the second protrusion 28a, the diameter of the second recess 3b, the size of the second gap B2 and the viscous liquid 29, as long as the first and second rotary decorations 10 and 13 are being driven.

Thus, there is no undesirable difference, or lack of uniformity, in rotation between the first and second rotary decorations 10 and 13 when the driving device of this invention is employed.

What is claimed is:

1. A rotary decoration driving device comprising:

a first rotary shaft supported rotatably on a lower case and extending vertically through an intermediate plate, the first rotary shaft having a first gear, one of the first gear and the lower case having a first protrusion and the other of the first gear and the lower case having a first recess receiving the first protrusion with a loose fit and defining a first gap therebetween, and a viscous liquid disposed in the first gap;

a first decoration carried by the first rotary shaft;

a second rotary shaft disposed around the first rotary shaft for rotation therewith and movable in the direction of gravity, the second rotary shaft having a second gear connected to the first gear by a train of wheels, one of the second gear and the intermediate plate having a second protrusion and the other of the second gear and the intermediate plate having a second recess receiving the second protrusion with a loose fit and defining a second gap therebetween, and a viscous liquid disposed in the second gap; and a second rotary decoration carried by the second rotary shaft.

2. A rotary decoration driving device as set forth in claim 1; wherein during rotation of the first and second rotary shafts the first gear has a first viscosity resistance and the second gear has a second viscosity resistance substantially equal to the first viscosity resistance.

3. A rotary decoration device as set forth in claim 1; wherein the first gear has the first protrusion, and the second gear has the second protrusion.

4. A rotary decoration device as set forth in claim 1; further comprising at least one intermediate gear driven to undergo intermittent rotation; transmitting means for transmitting the intermittent rotation of the intermediate gear to the first gear; and means for absorbing the intermittency of rotation of the intermediate gear to thereby transmit a smooth and continuous rotary motion to the first gear.

5. A rotary decoration device as set forth in claim 4; wherein the absorbing means comprises a shaft having an end portion rotatably supported by the lower case, a gear member mounted on the shaft for rotation relative thereto, a disk member mounted on the shaft for rotation therewith, and an elastic member disposed between the gear member and the disk member.

6. A rotary decoration device as set forth in claim 5; wherein the elastic member comprises a coil spring.

7. A rotary decoration device as set forth in claim 6; further comprising a stepping motor for intermittently rotationally driving the intermediate gear.

8. A rotary decoration device as set forth in claim 4; further comprising a stepping motor for intermittently rotationally driving the intermediate gear.

9. A rotary decoration driving device comprising: a case; a first rotary shaft having a first end portion rotatably supported by the case and a second end portion supporting a first decoration for rotation therewith; a second rotary shaft mounted on the first rotary shaft for rotation therewith and having an end portion supporting a second decoration for rotation therewith; a first gear mounted on the first rotating shaft for rotation therewith; a second gear mounted on the second rotating shaft for rotation therewith; at least one intermediate gear driven to undergo intermittent rotation during use of the rotary decoration driving device; transmitting means for transmitting the intermittent rotation of the intermediate gear to the first and second gears; and smoothing means for smoothing the intermittent rotation of the intermediate gear to thereby transmit a smooth and continuous rotary motion to the first and second gears.

10. A rotary decoration driving device as set forth in claim 9; wherein the smoothing means comprises a first annular projection extending from one of the first gear and a surface of the case and defining a first cavity, a first tubular shaft portion extending from the other of the first gear and the surface of the case and extending into the first cavity to define a first clearance between the first annular projection, the first cavity and the first tubular shaft portion, and a viscous fluid disposed in the first clearance.

11. A rotary decoration driving device as set forth in claim 10; further comprising a plate connected to the case; and wherein the smoothing means further comprises a second annular projection extending from one of the second gear and a surface of the plate and defining a second cavity, a second tubular shaft portion extending from the other of the second gear and the surface of the plate and extending into the second cavity to define a second clearance between the second annular projection, the second cavity and the second tubular shaft portion, and a viscous fluid disposed in the second clearance.

12. A rotary decoration driving device as set forth in claim 11; wherein the first tubular shaft portion extends from the first gear, and the second tubular shaft portion extends from the second gear.

13. A rotary decoration driving device as set forth in claim 11; wherein the transmitting means includes means for absorbing the intermittency of rotation of the intermediate gear to thereby transmit a smooth and continuous rotary motion to the first gear.

14. A rotary decoration driving device as set forth in claim 13; wherein the absorbing means comprises a shaft having an end portion rotatably supported by the case, a gear member mounted on the shaft for rotation relative thereto, a disk member mounted on the shaft for rotation therewith, and an elastic member disposed between the gear member and the disk member.

15. A rotary decoration driving device as set forth in claim 14; wherein the elastic member comprises a coil spring.

16. A rotary decoration driving device as set forth in claim 9; wherein the transmitting means includes absorbing means for absorbing the intermittency of rotation of the intermediate gear to thereby transmit a smooth and continuous rotary motion to the first gear.

17. A rotary decoration driving device as set forth in claim 16; wherein the absorbing means comprises a shaft having an end portion rotatably supported by the case, a gear member mounted on the shaft for rotation relative thereto, a disk member mounted on the shaft for rotation therewith, and an elastic member disposed between the gear member and the disk member.

18. A rotary decoration driving device as set forth in claim 17; wherein the elastic member comprises a coil spring.

19. A rotary decoration driving device, comprising:

a case;

a rotary shaft having a first end portion rotatably supported by the case and a second end portion supporting a decoration for rotation therewith;

a gear mounted on the rotary shaft for rotation therewith;

a rotary member driven to undergo intermittent rotation during use of the rotary decoration driving device;

transmitting means for transmitting the intermittent rotation of the rotary member to the gear; and damping means for damping the intermittent rotation transmitted to the gear to thereby transmit a smooth and continuous rotary motion to the gear.

20. A rotary decoration driving device as set forth in claim 14; wherein the damping means comprises a projection extending from one of the gear and a surface of the case and defining a cavity, a shaft portion extending from the other of the gear and the surface of the case and extending into the cavity to define a clearance defined by the projection, the cavity and the shaft portion, and a damping fluid disposed in the clearance.

21. A rotary decoration driving device as set forth in claim 20; wherein the projection extends from the surface of the case, and the shaft portion extends from the gear.

22. A rotary decoration driving device, comprising:

a case;

a first rotary shaft having a first end portion rotatably supported by the case and a second end portion supporting a first decoration for rotation therewith;

a first gear mounted on the first rotary shaft for rotation therewith;

at least one intermediate gear driven to undergo intermittent rotation during use of the rotary decoration driving device;

transmitting means for transmitting the intermittent rotation of the intermediate gear to the first gear;

a first damping device for damping the intermittent rotation transmitted to the first gear to thereby transmit a smooth and continuous rotary motion to the first gear;

a second rotary shaft mounted on the first rotary shaft for rotation therewith and having an end portion supporting a second decoration for rotation therewith;

a second gear mounted on the second rotating shaft for rotation therewith;

at least one rotary member for transmitting rotation of the first gear to the second gear; and a second damping device for damping the rotation transmitted to the second gear to thereby transmit a smooth and continuous rotary motion to the second gear.

23. A rotary decoration driving device as set forth in claim 22; wherein the transmitting means includes a third damping device for damping the intermittent rotation transmitted to the first gear to thereby transmit a smooth and continuous rotary motion to the first gear.

24. A rotary decoration driving device as set forth in claim 23; wherein the third damping device comprises a shaft having an end portion rotatably supported by the case, a first rotary member mounted on the shaft for relative rotation thereof, a second rotary member mounted on the shaft for rotation therewith, and an elastic member disposed between the first rotary member and the second rotary member.

25. A rotary decoration driving device as set forth in claim 24; wherein the elastic member comprises a coil spring.

26. A rotary decoration driving device as set forth in claim 24; wherein the first damping device comprises a first projection extending from one of the first gear and a surface of the case and defining a first cavity, a first shaft portion extending from the other of the first gear and the surface of the case and extending into the first cavity to define a first clearance defined by the first projection, the first cavity and the firt shaft portion, and a damping fluid disposed in the clearance; and wherein the second damping device comprises a second projection extending from one of the second gear and a surface of a plate connected to the case and defining a second cavity, a second shaft portion extending from the other of the second gear and the surface of the plate and extending into the second cavity to define a second clearance defined by the second projection, the second cavity and the second shaft portion, and a damping fluid disposed in the second clearance.

27. A rotary decoration driving device as set forth in claim 26; wherein during rotation of the first and second rotary shafts, the first damping device imparts a first viscosity resistance to the first gear and the second damping device imparts a second viscosity resistance to the second gear substantially equal to the first viscosity resistance.

28. A rotary decoration driving device as set forth in claim 22; wherein the first damping device comprises a first projection extending from one of the first gear and a surface of the case and defining a first cavity, a first shaft portion extending from the other of the first gear and the surface of the case and extending into the first cavity to define a first clearance defined by the first projection, the first cavity and the first shaft portion, and a damping fluid disposed in the clearance; and wherein the second damping device comprises a second projection extending from one of the second gear and a surface of a plate connected to the case and defining a second cavity, a second shaft portion extending from the other of the second gear and the surface of the plate and extending into the second cavity to define a second clearance defined by the second projection, the second cavity and the second shaft portion, and a damping fluid disposed in the second clearance.

29. A rotary decoration driving device as set forth in claim 28; wherein during rotation of the first and second rotary shafts, the first damping device imparts a first viscosity resistance to the first gear and the second damping device imparts a second viscosity resistance to the second gear substantially equal to the first viscosity resistance.

* * * * *